United States Patent [19]

Kaldenbach

[11] Patent Number: 4,973,200

[45] Date of Patent: Nov. 27, 1990

[54] METHOD FOR MANOEUVERING A SUPERSTRUCTURE ELEMENT RELATIVE TO A FIXED CONSTRUCTION ARRANGED IN WATER, METHOD FOR CONSTRUCTING A BUILDING STRUCTURE AND BUILDING STRUCTURE CONSTRUCTED ACCORDING TO SUCH A METHOD

[75] Inventor: Willem P. Kaldenbach, The Hague, Netherlands

[73] Assignee: Allseas Engineering B.V., The Hague, Netherlands

[21] Appl. No.: 427,983

[22] Filed: Oct. 30, 1989

Related U.S. Application Data

[63] Continuation of Ser. No. 140,619, Jan. 4, 1988, abandoned.

[30] Foreign Application Priority Data

Jan. 14, 1987 [NL] Netherlands ..... 8700076
Aug. 6, 1987 [NL] Netherlands ..... 8701856

[51] Int. Cl.[5] ..... E02D 25/00; E02B 17/00

[52] U.S. Cl. ..... 405/205; 405/203; 405/206; 405/209

[58] Field of Search ..... 405/195, 203–207, 405/209; 114/258, 259, 264, 265

[56] References Cited

U.S. PATENT DOCUMENTS

| | | | |
|---|---|---|---|
| 4,252,469 | 2/1981 | Blight et al. | 405/204 |
| 4,662,788 | 5/1987 | Kypke et al. | 405/204 |
| 4,714,382 | 12/1987 | Khachaturian | 405/204 |
| 4,729,695 | 3/1988 | Silvestri | 405/204 |

FOREIGN PATENT DOCUMENTS

| | | | |
|---|---|---|---|
| 101913 | 6/1983 | Japan | 405/195 |
| 155509 | 7/1986 | Japan . | |
| 2156286 | 10/1985 | United Kingdom . | |
| 2165188 | 4/1986 | United Kingdom . | |

*Primary Examiner*—Randolph A. Reese
*Assistant Examiner*—John Ricci
*Attorney, Agent, or Firm*—Watson, Cole, Grindle & Watson

[57] ABSTRACT

A buoyant vessel which alone can support a heavy superstructure has a well within which a floating body is disposed. The floating body can displace sufficient water in the well to support the superstructure by itself. Valves are provided for transferring water into and out of the body to lower and raise the superstructure with respect to the water surface on which the vessel is floating.

36 Claims, 6 Drawing Sheets

1
2
3
4
5
7
8
9
10
12
13
15
18
27
28
30
31
43
44
46
49
53
54
81
82
89
II
VII

FIG. 2
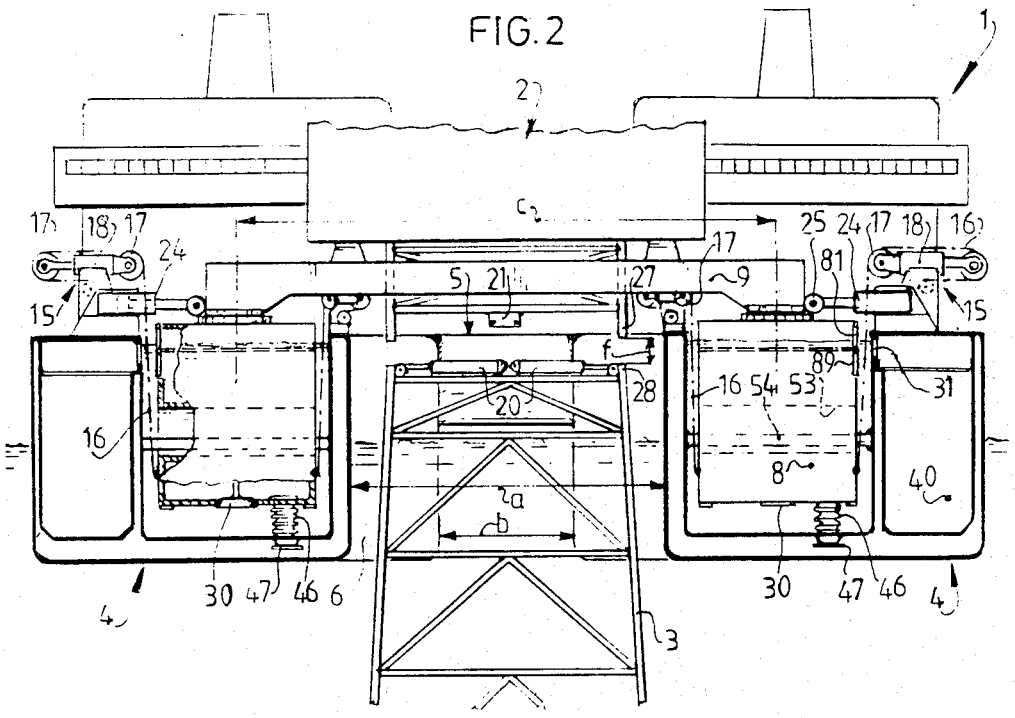
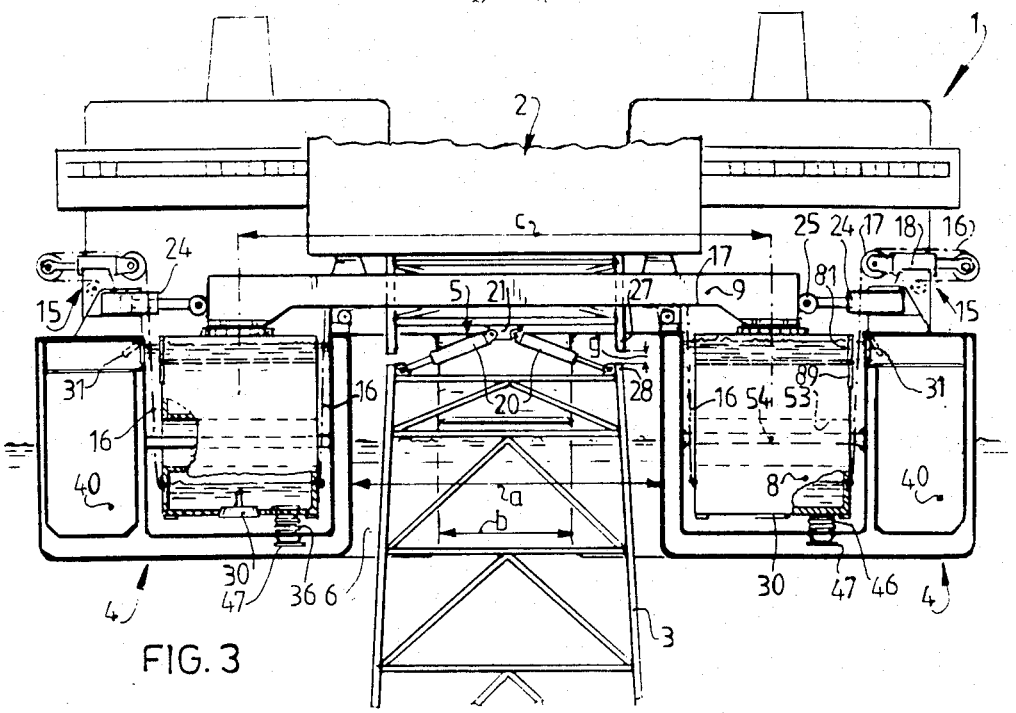
FIG. 3

FIG. 4
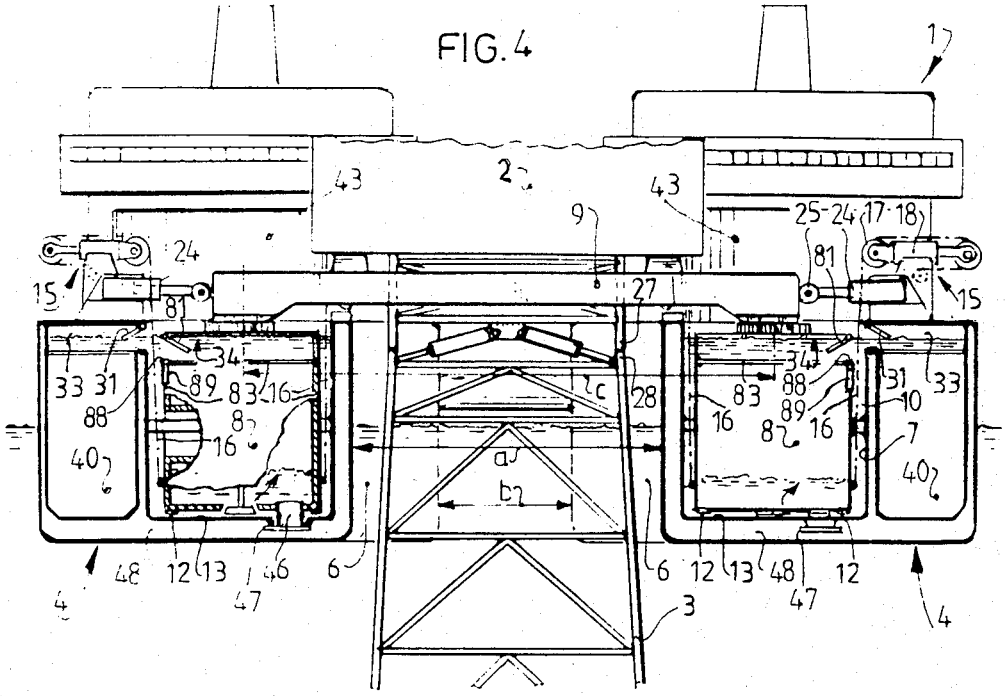
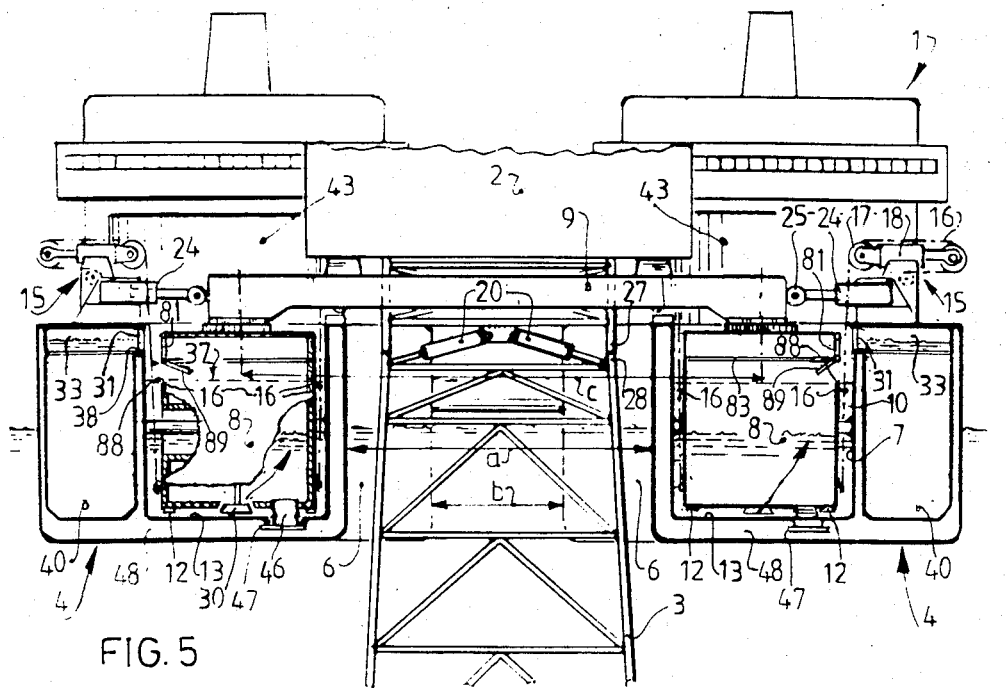
FIG. 5

FIG. 6
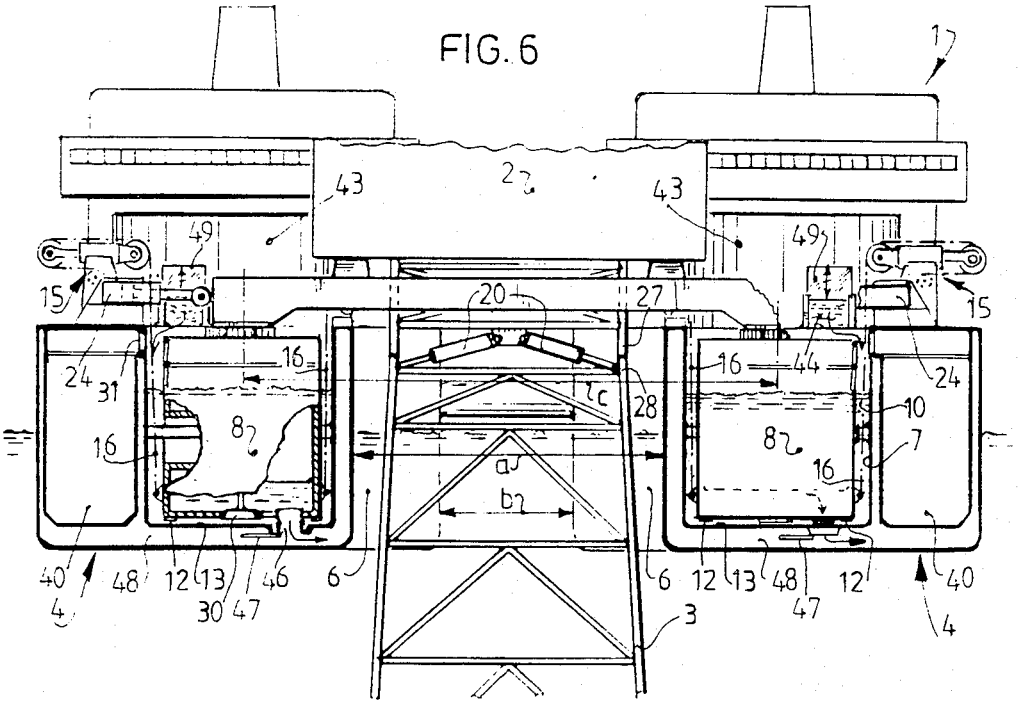
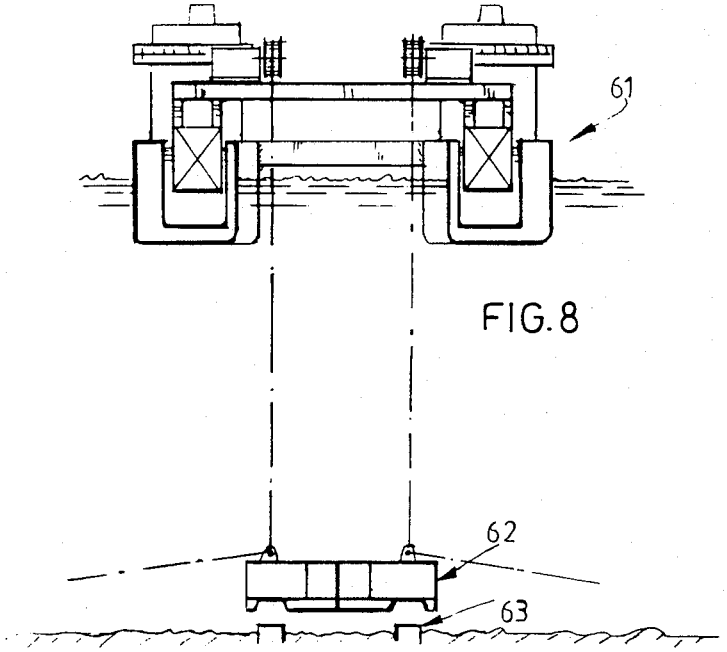
FIG. 8

METHOD FOR MANOEUVERING A SUPERSTRUCTURE ELEMENT RELATIVE TO A FIXED CONSTRUCTION ARRANGED IN WATER, METHOD FOR CONSTRUCTING A BUILDING STRUCTURE AND BUILDING STRUCTURE CONSTRUCTED ACCORDING TO SUCH A METHOD

This application is a continuation, of application Ser. No. 140,619, filed Jan. 4, 1988 now abandoned.

When a vessel element which holds a superstructure element at a small height difference above a fixed construction moves up and down as a result of wave movement, there is a great danger that the superstructure element will strike against the fixed construction with one or more violent impacts, such that the manoeuvre causes expensive damage to the fixed construction and/or the superstructure element. This danger of damage is markedly decreased if, during manoeuvering, the superstructure element is carried by at least one floater body that is held in at least one liquid bath carried by the vessel element. As a result, a loose vertical coupling can be realized during the first vertical contact between superstructure element and fixed construction.

If at least one refitted ship of large load capacity is employed as the vessel element, the vertical, reciprocating rolling movement is small, which reduces the problem considerably. This method can in addition be performed with a comparatively small investment, when supertankers surplus to requirements are available.

The invention can be used for the placing of a superstructure element as well as for its removal. It is also of importance that a superstructure element that may have been incorrectly placed on the fixed construction can again be removed in order to repeat the manoeuvre.

The invention also relates to and provides an installation for performing the inventive method, as well as a method for constructing a building structure in water and a thus-formed building structure.

During lowering of the superstructure element onto the fixed construction the liquid surface area is enlarged in order to limit the vertical movement of the floater body as a result of swell. The vertical movement that still occurs can be compensated for by swell compensators. The vertical movement to be compensated for by the swell compensators is preferably limited still further.

By using a part of the floater body for enlarging the water surface area, as a result of the loading thereof the weight of the floater body is increased so that the effect of enlarging the water surface area and increasing the weight of the floater body is combined. The floater body will therefore want to follow the movements of the vessel only to a very limited extent, which can be compensated for by swell compensators.

When the legs make contact with the pile heads, overflow valves to the floater bodies are opened at the same time. The liquid surface of the liquid baths then falls virtually immediately to the level of the overflow edge. As a result of the water flowing into the floater body, its weight is increased additionally and the load of the superstructure element on the pile heads increases rapidly. A wave surge that may occur no longer has any effect therefore on the position of the superstructure element.

The invention will be elucidated in the description following hereinafter with reference to the accompanying drawings.

BRIEF DESCRIPTION OF THE DRAWINGS

In the drawings in schematic form:

FIGS. 2–5 show partly schematic cross sections along plane II—II of the installation in successive later stages during performing of the method according to the invention when the superstructure element is lowered onto a fixed construction;

FIG. 6 is a cross section corresponding with FIG. 2 of the installation during raising of the superstructure element from the fixed construction;

FIGS. 8 and 9 are schematic examples of other installations for placing other superstructure elements on other fixed constructions.

DETAILED DESCRIPTION OF THE PREFERRED EMBODIMENT

Figure 1:
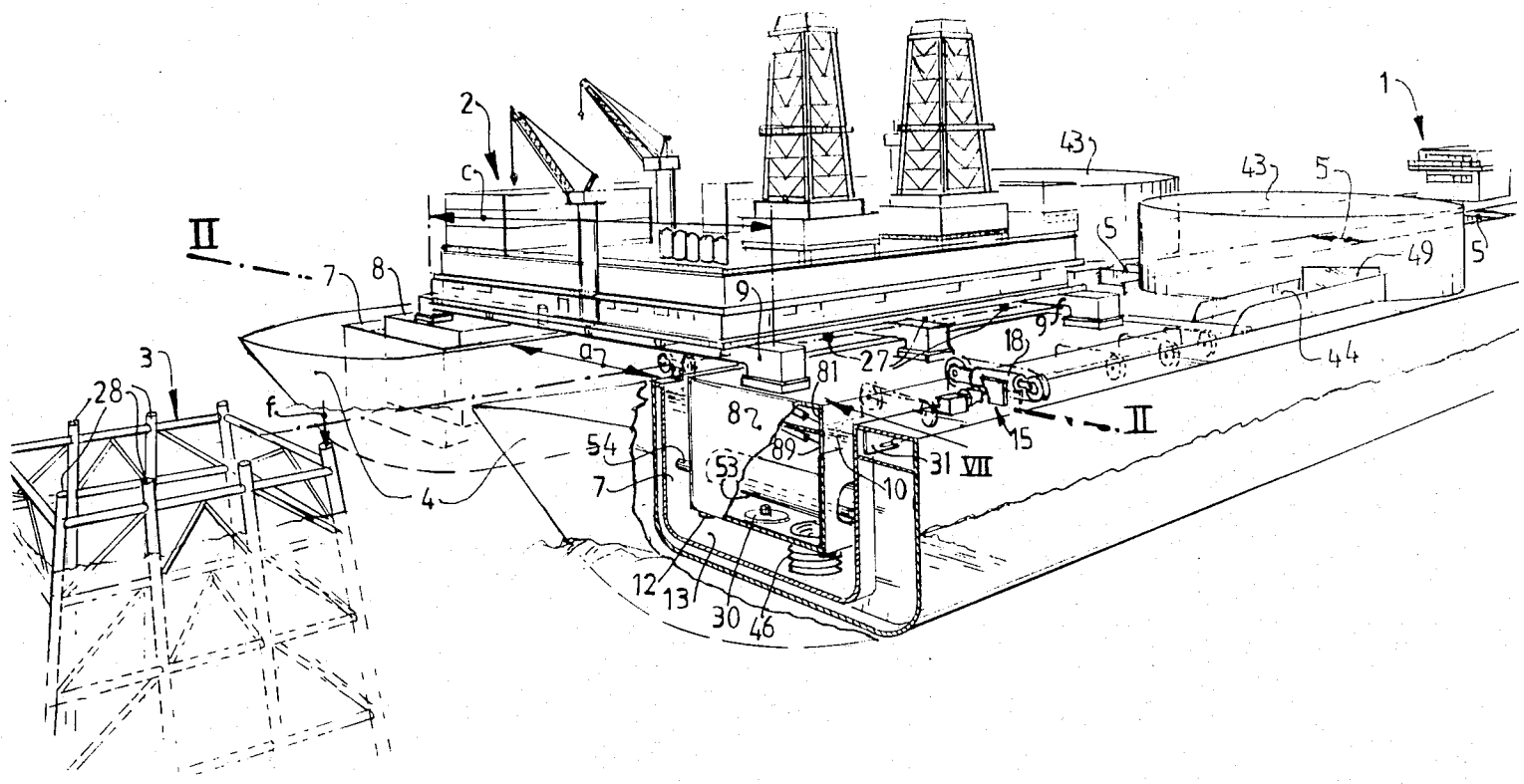
FIG. 1 shows a broken away, perspective view of a preferred embodiment of an installation as according to the invention with which a superstructure element is transported to a fixed construction arranged in water.

A fixed construction 3 shown in FIGS. 1–7 consists of a tower anchored to the sea-bottom. Placed hereon is a superstructure element 2 which is prefabricated on shore and has a weight in the order of magnitude of 10,000 tons or more, for example 30,000 to 40,000 tons. Great problems occur with such heavy objects in controlling their horizontal and vertical movements, particularly during wave surge. An example of a construction is a building structure which forms an artificial island and which is used for surveying of the sea-bottom and/or extracting oil and/or gas.

The installation 1 comprises two vessel elements 4, namely two identical tanker ships of large dimensions, for example 100,000 tons, and preferably 300,000 tons each, so-called very large crude carriers, with a length of 340 m, a width of 53 m and a deck height of 28 m relative to the ship bottom. Such tankers are laid up and available at scrap prices.

The rear ends of vessel elements 4 are connected parallel to each other by means of bridge members 5. On their front ends, that is, on their sides facing each other, the vessel elements 4 have been given a recess 6 such that their distance from each other a at that point is greater than the mutual distance b at the rear ends.

Of importance is that, at least at the front end, there is sufficient distance present between them to accommodate the fixed construction 3. The recesses 6 have the advantage that the bearing width c of superstructure element 2 on vessel elements 4 is thereby reduced and the bridging members become simpler. It is equally conceivable that such recesses 6 are not applied. The rear end, that is the driving and accommodation of the tankers, is preserved. Cargo holds of the tankers are converted into liquid baths 7 in which are arranged floater bodies 8. The latter consist of tanks with a large volume such that their buoyancy can together support the weight of the superstructure element 2 and the girder bridges 9 when they are floating in the water 10 present in the liquid baths. Girder bridges 9 are supported on floater bodies 8 and are secured during transport by securing means (not shown). Floater bodies 8 have feet 12 with which they stand fixed on the bottoms 13 of liquid baths 7 during the transport of superstructure element 2 to fixed construction 3.

Having arrived at the fixed construction 3 the vessel elements 4 are ballasted by allowing surrounding outside water into various tanks. The liquid baths 7 are in any case filled with water, whereby the empty floater bodies 8 float upward. There is then a difference in height f of for instance 4 m between legs 27 of the superstructure element 2 and the corresponding pile heads 28 of fixed construction 3. In this situation the vessel elements 4 are navigated to either side of the fixed construction 3 (see FIG. 2). Use may hereby be made of anchor cables and or the propeller screws (not shown) of vessel elements 4. The floater bodies 8 are also carried by means of per se known swell compensators 15 which are controlled subject to the movements of vessel elements 4 and which comprise carrying ropes 16 guided repeatedly around pulleys 17 and hydropneumatic cylinders 18. It is noted that superstructure element 2, together with the girders 9 connected thereto and the floater bodies in turn connected to girders 9, form a stable vessel for floating on water.

When vessel elements 4 are situated roughly in position on either side of the fixed construction, non-actuated, horizontal hydropneumatic cylinders 20 already connected beforehand for pivoting on the fixed construction 3 are coupled for pivoting to projections 21 of superstructure element 2. Hydropneumatic holding cylinders 24, which support via rolls 25 against vertical end faces of girders 9, are actuated in order to hold superstructure element 2 in position in a horizontal direction relative to installation 1, while these cylinders 24 permit a relative vertical movement of the superstructure element 2 together with girders 9 and floater bodies 8.

Also present in lengthwise direction of vessel elements 4 are horizontal cylinders corresponding with cylinders 24 and 20. Using per se known measuring means (not described and not shown) the position of the legs 27 relative to the corresponding heads 28 of fixed construction 3 is measured, the one being arranged exactly above the other by regulating adjustment in opposing directions of pairs of cylinders 24 disposed opposite each other which still hold superstructure element 2 fixed in position between them. By regulating a pair of cylinders 24 arranged at the front end in opposing sense relative to a pair of cylinders 24 arranged at the rear end, the horizontal rotation can be controlled.

In this situation the superstructure element 2 is lowered to a small height difference g above fixed construction 3 by opening bottom valves 30 of floater bodies 8 so that water 10 flows out of liquid baths 7 into floater bodies 8, until the difference in height g (FIG. 3) amounts for example to just 2 m. Bottom valves 30 are then closed again. The spring rigidity of the hydropneumatic cylinders 24 is then simultaneously decreased and the spring rigidity of the hydropneumatic cylinders 20 is increased. In order to minimize the forces exerted by the superstructure element via the cylinders 20 on the fixed construction 3, the pressures of cylinders 20 are measured and cylinders 24 are actively actuated in selective manner as required. When superstructure element 2 is no longer moving in a horizontal direction relative to fixed construction 3, the superstructure element 2 is lowered onto fixed construction 3 by re-opening bottom valves 30. During this lowering, shut-off valves 31 on the upper part of liquid baths 8 are also opened, which results in additional liquid baths 33, located at a higher level, being filled with water from liquid baths 7. Created as a result is a large liquid surface area 34 (FIG. 4) common to liquid baths 7 and the associated additional liquid baths 33, as a result of which the vertical movement of floater bodies 8 causes the liquid surface area 34 to rise and fall to a lesser extent, so that the variation in the upward force is small. In other words, the vertical coupling between installation 1 and superstructure element 2 consequently becomes looser. Swell compensators 15 are in the meantime controlled such that vertical movements of vessel elements 4 are compensated. As soon as legs 27 make contact with the pile heads 28, overflow valves 89 to the floater bodies 8 are simultaneously opened, valves 31 81 are closed, and the lifting force of swell compensators 15 is virtually entirely eliminated. The liquid surface 34 of liquid baths 7 then falls almost immediately to the overflow brim 88 (see FIG. 5) so that the buoyancy of floater bodies 8 decreases in large degree, as a result of which the load transfer of the superstructure element 2 onto the pile heads 28 increases correspondingly rapidly. In the meantime water 10 is still flowing out of liquid baths 7 into floater bodies 8, resulting in the buoyancy of the floater bodies 8 decreasing still further. If meanwhile as a result of the upward swell movement of vessel elements 4 the floater bodies 8 are immersed slightly deeper into the liquid baths 7, more extra water may flow over the overflow brim 88 into floater bodies 8. Even if the floater bodies 8 were to be immersed further into the liquid 10 of liquid baths 7, the buoyancy would still never increase to the extent that superstructure element 2 is again lifted from pile heads 28. The increase in buoyancy is in any event limited by the level of the overflow brim 88. When the liquid level in and outside floater bodies 8 is equal, the upward force is zero, which means that the weight of the superstructure element 2 is fully supported by pile heads 28.

When it has been established that superstructure element 2 is standing in correct position on fixed construction 3, bridge girders 9 are released by disconnecting quick action couplings (not drawn) between girders 9 and floater bodies 8, the vessel elements 4 are further ballasted with water and the deep-lying installation 1 is removed backwards from fixed construction 3, leaving girders 9 behind.

If it should be the case that the superstructure element 2 is placed incorrectly on fixed construction 3, it can again be lifted up using installation 1 with small—that is, virtually without—risk of damage. The installation 1 comprises for this purpose storage tanks 43 disposed at a high level, each of which connects via channel 44 onto liquid baths 7. When lifting takes place, the following procedure is employed, starting from a situation where the installation 1 is located in position around fixed construction 3 and the vessel elements 4 are lying deep in the water, whereby the horizontal anchoring of installation 1 to superstructure element 2 is still very loose, that is, the cylinders 24 are not actuated. All the water is then first discharged from floater bodies 8 via hoses 46 and valves 47 to be opened, with bottom valves 30 remaining closed. This water then flows into ballast holds 48.

Water is subsequently pumped out of the ballast holds 48 in order to cause the vessel elements 4 to rise, in so far as this is necessary. When a small difference in level has been reached between superstructure element 2 and fixed construction 3, slide hatches 49 of storage tanks 43 are opened simultaneously so that the storage water runs via channels 44 into liquid baths 7, while valves 89 are closed. Care is also taken that during the period of release of superstructure element 2 from fixed construction 3 a large liquid surface area is present, by making use of the additional liquid baths 83, valves 81 being open. In the meantime the swell compensators 15 are utilized. When superstructure element 2 has been lifted sufficiently high, it can again be re-positioned. The spring rigidity of the cylinders 20 is reduced and that of cylinders 24 increased if the superstructure element 2 has to be removed.

Figure 7:
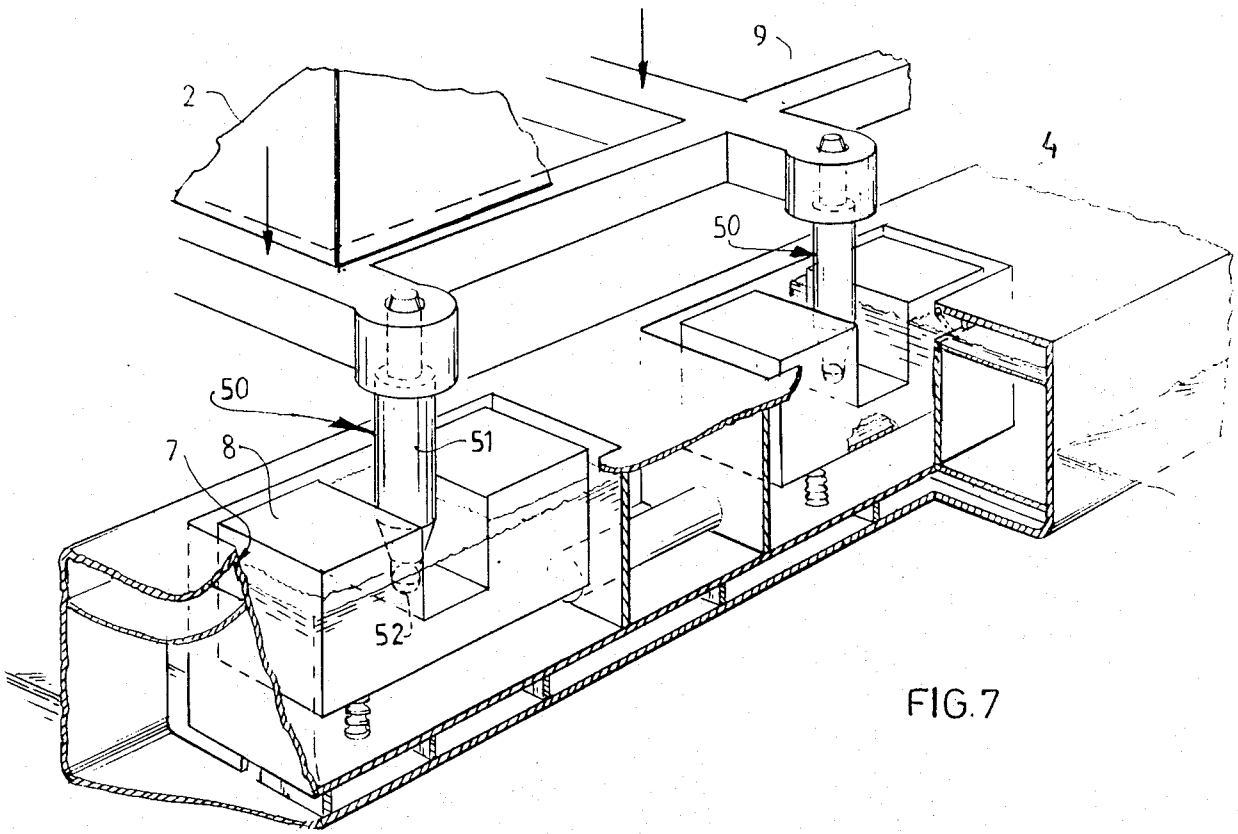
FIG. 7 shows the detail VII from FIG. 1 adapted into a preferred embodiment.

As in FIG. 7, support means 50 are preferably arranged between the floater bodies 8 and superstructure element 2, these means consisting of removable columns 51 which grip with ball and socket joints 52 at low level on floater bodies 8, or at least at a low level such that these floater bodies 8 lie stable in the liquid baths 7. A plurality of liquid baths 7 with associated floater bodies 8 can be arranged in each vessel element 4. The existing transport reservoirs of tankers can thus be used as liquid baths 7 without a great deal of refitting.

The floater bodies 8 preferably have horizontal passages 53 to allow water to flow easily from one side of the floater bodies 8 to the other. Horizontal supports 54 can moreover be fitted through the bodies 8 for support of the bath walls where necessary. Instead of cylinders 20 and 24, winch cables can also be employed, whereby the tensile stress of the cables is adapted for altering in reverse sense the rigidity of the horizontal coupling between superstructure element 2 and fixed construction 3 on the one hand and of the coupling between superstructure element 2 and installation 1 on the other.

FIG. 8 shows that the installation 1 or at least an installation 61 similar to it can be very usefully employed for removing a superstructure element 2 from fixed constructions 3 as well as for sinking a superstructure or tunnel element 62 down onto a foundation 63. Ships that have sunk can also be raised according to this method.

It is remarked that instead of two vessels linked together by means of bridging members, the installation can comprise a single U-shaped vessel, the legs of this U forming vessel elements. Instead of the converted large tankets considered preferable, two assembled vessel elements may also be used that are provided with substantial ballast tanks, so that the level of these vessel elements can be adapted considerably relative to the surrounding outside water surface.

It is noted that in order to compensate a rolling movement of installation 1 the liquid baths 7 in both vessel elements 4 could be communicating. The bridge girders 9 are for example detached later from the superstructure element 2 and removed if they do not at least form part of the construction of superstructure element 2.

Figure 9:
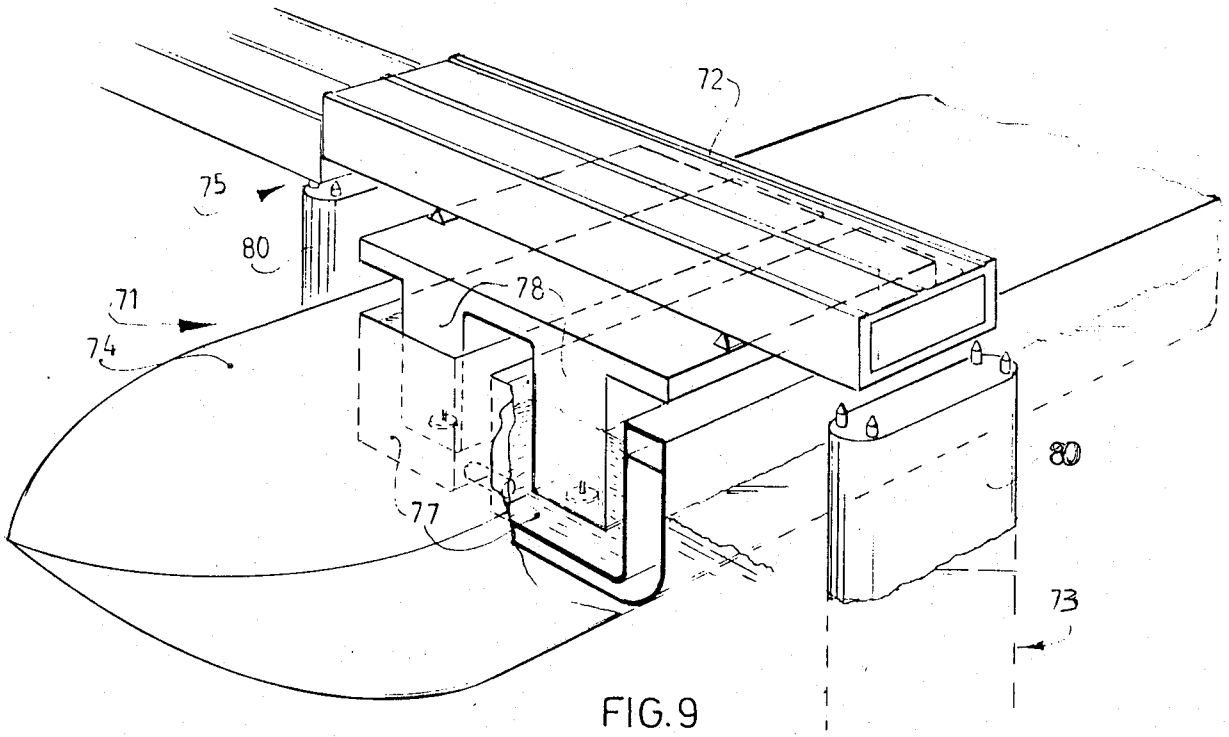

As seen in FIG. 9 a bridge 75 is being built, whereby a superstructure element 72 is placed on the fixed construction 73 using an installation 71 by means of a single vessel element 74 navigated between the bridge pillars 80. Vessel element 74 has liquid baths 77 in which are held floater bodies 78 which bear the superstructure element 72. The lowering of superstructure element 72 onto pillars 80 is in principle carried out further in the same manner as is described with reference to the FIGS. 1–6.

I claim:

1. The method of building a marine structure which comprises the steps of (a) providing a fixed supporting structure in a body of water and having an upper portion upon which a superstructure is to be relatively positioned and supported, (b) constructing the superstructure at a site remote from the supporting structure, (c) transporting the superstructure from the site to a position adjacent the supporting structure by supporting the superstructure on a buoyant vessel, (d) controlling the elevation of the superstructure above the upper portion of the supporting structure by buoying the superstructure within and relative to the buoyant vessel, and then (e) lowering the superstructure into position supported by the supporting structure.

2. The method as defined in claim 1 wherein step (e) includes decreasing the buoying of the superstructure relative to the buoyant vessel without changing the ballast of the buoyant vessel.

3. The method as defined in claim 2 wherein step (d) comprises buoying a floating body supporting the superstructure within the buoyant vessel and step (e) also includes ballasting the floating body to remove any support of the superstructure by the floating body, and transporting the buoyant vessel away from the superstructure as wholly supported by the supporting structure.

4. The method of building a marine structure which comprises the steps of (a) providing a fixed supporting structure in a body of water and having an upper portion upon which a superstructure is to be supported, (b) supporting the superstructure on a buoyant vessel, and then (c) buoying the superstructure relative to the buoyant vessel into supported position on the supporting structure.

5. A marine structure constructed in accord with claim 4.

6. The method of maneuvering a superstructure relative to a fixed construction, which comprises the steps of:

providing a buoyant vessel having a liquid bath;

providing a floating body in the liquid bath; and supporting a superstructure on the buoyant vessel through the medium of the floating body.

7. The method as defined in claim 6 including the step of enlarging the liquid surface area of the liquid bath which acts on the floating body.

8. The method as defined in claim 7 wherein the liquid surface area is enlarged by communicating the liquid bath with an upper region of the floating body.

9. The method of maneuvering a heavy marine structure at a particular location in a body of water, which comprises the steps of;

providing buoyant vessel structure having sufficient displacement to buoy the marine structure, providing a well in the vessel structure having sufficient capacity to receive that displacable volume of water required to buoy the marine structure relative to said buoyant vessel, providing a floatable body in said well having displacement sufficient to buoy the marine structure within and relative to the vessel structure, supporting the marine structure on the vessel structure through the medium of the floatable body, and buoyantly maneuvering the heavy marine structure by controlling the volume of water in said well displaced by said flotable body.

10. Apparatus for raising or lowering a heavy marine structure solely through buoyancy, which comprises:

buoyant vessel means having sufficient displacement for buoying the marine structure by itself, well means in said buoyant vessel means having sufficient capacity for receiving that displaceable volume of water required to buoy the marine structure relative to the buoyant vessel means, floatable body means vertically movable within said well means and having sufficient displacement by itself for buoying the marine structure relative to the vessel means, means for supporting the weight of said marine structure on said floatable body means, and means for controlling the volume of water in said well means for raising or lowering said heavy marine structure relative to the vessel means through buoyancy effected by the floatable body means.

11. Apparatus as defined in claim 10 wherein said floatable body means includes valve means for introducing water into and discharging water from the interior of said floatable body means.

12. Apparatus as defined in claim 10 wherein said floatable body means includes upper and lower non-communication regions, said means for controlling comprising first valve means for transferring water from said well means into the lower region of said floatable body means to lower the floatable body means within the well means, and second valve means for transferring water from the well means into the upper region of said floatable body means to lower the said floatable body means in the well means.

13. Apparatus as defined in claim 10 wherein said floatable body means includes upper and lower non-communication regions, said means for controlling comprising first valve means for transferring water from said well means into the lower region of said floatable body means to lower the floatable body means within the well means, second valve means for transferring water from the well means into the upper region of said floatable body means to lower the said floatable body means in the well means, and third valve means for transferring water from said floatable body means back into the well means.

14. Apparatus as defined in claim 13 wherein said means for controlling also includes fourth valve means for transferring water from the well means into the vessel means to deplete the volume of water in the well means.

15. Apparatus as defined in claim 10 wherein said floatable body means includes upper and lower non-communicating regions, said means for controlling includes means for filling the well means with water to a level therein to buoy the floatable body means within the well means to a predetermined height, first valve means for transferring water from said well means into the lower region of said floatable body means to decrease the buoyancy of the floatable body means within the well means without altering the level of water in the well means, second valve means for transferring water from the well means into the upper region of the floatable body means to further decrease the buoyancy of floatable body means in the well means and for transferring water from the well means exteriorly thereof so as to lower the level of water in the well means, and third valve means for dumping water above a certain height from the lower region of the floatable body means in the floatable body means back into the well means greatly to decrease the buoyancy of the floatable body means while rapidly lowering the level of water in said well means.

16. The method of maneuvering a heavy weight superstructure relative to a fixed construction in a body of water and capable of supporting the weight of the superstructure, which comprises the steps of:

providing a buoyant vessel having sufficient buoyancy by itself to support the weight of the superstructure; and providing a floating body within the buoyant vessel having sufficient buoyancy by itself to raise and lower the superstructure relative to the buoyant vessel.

17. The method as defined in claim 16 including the step of transferring the weight of the superstructure from the buoyant body to the fixed construction by decreasing the buoyancy of the buoyant body.

18. The method as defined in claim 17 wherein the buoyancy of the buoyant body is decreased relatively slowly until the superstructure is spaced a small distance above the fixed construction and is then decreased suddenly to transfer the full weight of the superstructure to the fixed construction.

19. The method as defined in claim 16 including the steps of raising and lowering the superstructure relative to the buoyant vessel by compensating for vertical wave motion acting on the buoyant vessel and lowering the superstructure relative to the fixed construction by transferring liquid into the buoyant body.

20. The method as defined in claim 19 wherein the buoyancy of the buoyant body is decreased relatively slowly until the superstructure is spaced a small distance above the fixed construction and is then decreased suddenly to transfer the full weight of the superstructure to the fixed construction.

21. The method of building a marine structure which comprises the steps of:

(a) providing a fixed supporting structure in a body of water which has an upper portion upon which a superstructure can be positioned and supported;

(b) constructing a superstructure at a site remote from the supporting structure;

(c) providing a buoyant vessel which contains a floating body;

(d) supporting the superstructure on the floating body with the buoyant vessel at the site;

(e) moving the buoyant vessel from the site to a position adjacent the fixed supporting structure; and (f) ballasting the floating body relative to the buoyant vessel to lower the superstructure onto the fixed supporting structure.

22. The method as defined in claim 21, wherein said fixed supporting structure consists of a foundation in a seabed and wherein said superstructure consists of a tunnel element.

23. The method of manoeuvering a superstructure relative to a fixed construction which comprises the steps of:

(a) providing a buoyant vessel having a liquid bath;

(b) providing a floating body in the liquid bath;

(c) supporting a superstructure on the buoyant vessel by the floating body; and (d) introducing liquid from the liquid bath into the floating body to vertically lower the superstructure relative to the buoyant vessel.

24. The method of maneuvering a heavy weight superstructure relative to a fixed construction in a body of water, the fixed construction being capable of supporting the weight of the superstructure, said method comprising the steps of:

providing a buoyant vessel having sufficient buoyancy by itself to support the weight of the superstructure;

providing a floating body within the buoyant vessel having sufficient buoyancy by itself to raise and lower the superstructure relative to the buoyant vessel;

supporting the superstructure with the floating body; and raising the superstructure relative to the fixed construction by transferring liquid out of the floating body.

25. The method of maneuvering a heavy weight body relative to a fixed underwater body, said method comprising the steps of:

(a) providing a buoyant vessel having sufficient buoyancy by itself to support the weight of the heavy weight body;

(b) providing a floating body within the buoyant vessel having sufficient buoyancy by itself to raise and lower the heavy weight body relative to the buoyant vessel;

(c) supporting the heavy weight body with the floating body; and (d) changing the level of the heavy weight body relative to the fixed underwater body.

26. The method according to claim 25, wherein in step (d) the heavy weight body is lowered relative to the fixed underwater body.

27. The method according to claim 26, wherein the buoyant vessel provides a liquid bath therein having a surface area and surface level, wherein the floating body is located in the liquid bath, and wherein in step (d) the surface level of the liquid bath is lowered.

28. The method according to claim 27, wherein the floating body is hollow and wherein in step (d) liquid from the liquid bath is passed into the floating body.

29. The method according to claim 27, wherein a surface area of the liquid bath is enlarged.

30. The method according to claim 26, wherein the fixed underwater body is a foundation in a seabed and in step (d) the heavy weight body is lowered onto the foundation.

31. The method according to claim 25, wherein in step (d) the heavy weight body is raised relative to the fixed underwater body.

32. The method according to claim 31, wherein the buoyant vessel provides a liquid bath therein having a surface level, wherein the floating body is located in the liquid bath, and wherein in step (d) the buoyancy of the buoyant vessel is reduced.

33. The method according to claim 32, wherein in step (d) additional liquid is supplied to the liquid bath to raise the surface level thereof.

34. The method according to claim 25, wherein the heavy weight body is a ship.

35. The method according to claim 25, wherein the fixed underwater body is a seabed.

36. The method according to claim 25, wherein the heavy weight body is a tunnel element and the fixed underwater body is a foundation in a seabed.

* * * * *